US011367978B2

(12) United States Patent
Hwang et al.

(10) Patent No.: US 11,367,978 B2
(45) Date of Patent: Jun. 21, 2022

(54) SELF-ALIGNING AND SELF-ASSEMBLING CONNECTORS

(71) Applicant: Canon U.S.A., Inc., Melville, NY (US)

(72) Inventors: Charles George Hwang, Wellesley, MA (US); Jacob Schieffelin Brauer, Cambridge, MA (US); Alexander Altshuler, Cambridge, MA (US); Aleksey Danilkin, Maynard, MA (US)

(73) Assignee: Canon U.S.A., Inc., Melville, NY (US)

( * ) Notice: Subject to any disclaimer, the term of this patent is extended or adjusted under 35 U.S.C. 154(b) by 114 days.

(21) Appl. No.: 16/829,708

(22) Filed: Mar. 25, 2020

(65) Prior Publication Data

US 2020/0313346 A1 Oct. 1, 2020

Related U.S. Application Data

(60) Provisional application No. 62/826,564, filed on Mar. 29, 2019.

(51) Int. Cl.

| | |
|---|---|
| ***H01R 13/56*** | (2006.01) |
| ***H01R 13/502*** | (2006.01) |
| ***H01R 13/72*** | (2006.01) |
| ***H01R 13/62*** | (2006.01) |

(52) U.S. Cl.

CPC ..... *H01R 13/56* (2013.01); *H01R 13/502* (2013.01); *H01R 13/6205* (2013.01); *H01R 13/72* (2013.01)

(58) Field of Classification Search

CPC .... H01R 13/72; H01R 13/56; H01R 13/6205; H01R 13/50; H01R 13/02; H02G 11/02

See application file for complete search history.

(56) References Cited

U.S. PATENT DOCUMENTS

| | | | | |
|---|---|---|---|---|
| 6,415,898 | B1 * | 7/2002 | Liao | H02G 11/02 191/12.4 |
| 7,311,526 | B2 | 12/2007 | Rohrbach et al. | |
| 7,347,734 | B1 * | 3/2008 | Teitelbaum | H01R 31/06 439/652 |
| 8,644,988 | B2 | 2/2014 | Prisco et al. | |
| 9,160,102 | B1 | 10/2015 | Morgan et al. | |
| 9,197,053 | B2 * | 11/2015 | Berger | H01R 13/72 |
| 9,306,322 | B2 | 4/2016 | Bhimavarapu et al. | |
| 9,325,130 | B2 * | 4/2016 | Lombardo | H01R 13/514 |

(Continued)

*Primary Examiner* — Briggitte R. Hammond

(74) *Attorney, Agent, or Firm* — Canon U.S.A., Inc., IP Division

(57) ABSTRACT

A connector apparatus configured to connect to a connection port in order to transfer data and/or electrical power between two electronic devices or between an electronic device and an electrical outlet, the connector apparatus comprising: a first part configured to connect to the connection port by friction; two or more coupling portions which can engage or disengage when a force is applied to at least one of the coupling portions; and a retracting mechanism which pulls the two or more coupling portions towards each other when the coupling portions are separated by a separating force larger than a threshold force; wherein the first part remains connected to the connection port, while the two or more coupling portions engage or disengage when the force is applied and/or while the retracting mechanism pulls the two or more coupling portions towards each other.

18 Claims, 8 Drawing Sheets

(56) References Cited

U.S. PATENT DOCUMENTS

| | | | | |
|---|---|---|---|---|
| 9,991,628 | B2 | 6/2018 | Daoura | |
| 10,199,783 | B2 * | 2/2019 | Finn | H01R 13/629 |
| 2012/0148195 | A1 | 6/2012 | Umeno | |
| 2012/0164849 | A1 | 6/2012 | Lee et al. | |

* cited by examiner

100

100

SELF-ALIGNING AND SELF-ASSEMBLING CONNECTORS

CROSS-REFERENCE TO RELATED APPLICATIONS

The present application claims priority to U.S. provisional application 62/826,564, filed Mar. 29, 2019, the disclosure of which is incorporated by reference herein in its entirety.

BACKGROUND INFORMATION

Field of the Disclosure

The present disclosure relates to a coupling connector for an electronic device. More specifically, the disclosure exemplifies self-aligning and self-assembling connectors for connecting electronic devices, in particular for electronic medical devices.

Description of Related Art

Electronic devices use data cables and/or power cables attached to a connector to establish a connection to other electronic devices or to a power source. Temporary electrical connection between two electronic devices or between an electronic device and a power source is typically carried out by friction fitting a connector to a connection port. In clinical settings, despite strict requirements for sterility and cleanliness, cables connecting medical equipment are frequently an afterthought, and are left lying across the floor or other surfaces. This situation places the connecting cables in a position to be stepped-on, kicked, tugged or snagged, potentially damaging the connectors, and also creating potentially hazardous conditions. These conditions could cause errors and/or delays in medical operations, as replacement cables have to be located and installed at the expense of increasing operational times and costs.

In other fields of technology, the state of the art for connectors which prevent damage by self-disconnecting when tugged is known. For example, Apple Inc. (Apple) manufactures and sells a magnetic connector cable by the trade name of MagSafe. Apple was granted U.S. Pat. No. 7,311,526 on a cable connect sold under the MagSafe name. According to this technology, the connector is held in place magnetically so that if it is tugged—for example, by someone tripping over the cord—the tugging will pull the connector out of the socket without damaging the connector or the power socket of the electronic device, and without pulling the electronic device off the surface on which it is located.

Also U.S. Pat. No. 9,160,102 B1 (Magnetic, self-retracting, auto-aligning electrical connector) describes an electrical coupling connector which when two outer ring magnets come into contact, they attach, and this causes two inner magnets to make a magnetic and electrical connection.

In the medical field, U.S. Pat. No. 9,306,322 B2 discloses a connector for a patient support apparatus. According to this patent, the patient support apparatus (e.g., a bed) is provided with a magnet-based electrical connector adapted to releasably couple to a complementary connector in order to transfer electrical power therebetween. The magnet is adapted to releasably hold the electrical connector and the complementary connector together and to assist in aligning the connector with the complementary connector. An indicator provides a visual indication when the electrical connector and the complementary connector are electrically coupled together.

While the foregoing state of the art shows an improvement in connectors, these connectors are generally limited by the need of user intervention to reconnect and/or reassemble the disrupted connection after a disconnection event takes place. That is, a user has to manually recouple the connection, and/or reassemble the connector parts, which is an issue if there are a multitude of cables and/or the connection port is difficult to access. In addition, the above-described magnet-based connectors rely on the condition that both connecting portions of a given connector (i.e., a connection port of a first device and a connector of a second device) must include a magnet in order to facilitate a disconnection without damage and in order to facilitate appropriate alignment. Moreover, the magnetic connection and re-alignment is limited to the short distances in which the magnetic field is effective as it is well known that the strength of a magnetic field varies inversely with the third power of distance.

However, when a magnet-based connector must be connected to a non-magnetic connection port of an existing device, the magnet-based connector may not be useful in preventing damage, preventing disconnection, or providing alignment. Moreover, in clinical settings, where there are strict requirements for sterility and cleanliness, cables connecting medical equipment are desired to be securely connected to avoid disconnection and to maintain sterility throughout a procedure. And, if the situation places the connecting cables of medical devices in a position to be stepped-on, kicked, tugged or snagged, it is desired that those cables be immediately reconnected and reassembled to avoid errors and/or delays in medical operations. Moreover, due to the strict requirements for sterility and cleanliness, it is desired that cables of medical devices be reconnected and reassembled preferably without manual intervention of a user.

SUMMARY OF EXEMPLARY EMBODIMENTS

According to at least one embodiment of the invention, there is provided a connector apparatus (100) configured to connect to a connection port (201) in order to transfer a digital signal and/or electrical power between two electronic devices or between an electronic device and an electrical outlet, the connector apparatus (100) comprising: a first part (107*a*) configured to connect to the connection port (201) by friction; two or more coupling portions (106, 104) which can engage or disengage when a force is applied to at least one of the coupling portions; and a retracting mechanism (105) which pulls the two or more coupling portions (106, 104) towards each other when the coupling portions are separated by a separating force (F2) larger than a threshold force (F1); wherein the first part (107*a*) remains connected to the connection port (201), while the two or more coupling portions (106, 104) engage or disengage when the force is applied and/or while the retracting mechanism (105) pulls the two or more coupling portions (106, 104) towards each other.

In one embodiment, the plurality of coupling portions includes a first coupling portion (106) having one or more first magnets and a second coupling portion (104) having one or more second magnets, wherein the first and second coupling portions are magnetically coupled to each other by the one or more first magnets and the one or more second magnets. In one embodiment connector apparatus further comprises a cord (103) attached to at least one of the first and second coupling portions, wherein the cord (103) transmits the digital signal and/or electrical power between two electronic devices or between an electronic device and an electrical outlet regardless of whether the first and second coupling portions are engaged or disengaged (FIGS. 5A-5B). In one embodiment, the threshold force (F1) is a force equal to a tension force exerted by the retracting mechanism to maintain the plurality of coupling portions (106, 104) engaged to each other, wherein the separating force (F2) is higher than the threshold force (F1) and lower than a force (F3) for engaging the first part (107*a*) to the connection port (201). In another embodiment, the threshold force (F1) is a force equal to a magnetic force exerted by the one or more first magnets and the one or more second magnets to maintain the first and second coupling portions (106, 104) magnetically coupled to each other, wherein the separating force (F2) is higher than the threshold force (F1) and lower than a force (F3) for engaging the first part (107*a*) to the connection port (201). In one embodiment, the retracting mechanism (105) is a self-retracting tether, wherein the first and second magnetically coupled portions are tethered to each other with the self-retracting tether (105) which pulls together the two magnetically coupled portions when they are separated by the separating force. The self-retracting tether includes one or a plurality of tethers (105*a*, 105*b*).

These and other objects, features, and advantages of the present disclosure will become apparent upon reading the following detailed description of exemplary embodiments of the present disclosure, when taken in conjunction with the appended drawings, and provided claims.

BRIEF DESCRIPTION OF DRAWINGS

Further objects, features and advantages of the present disclosure will become apparent from the following detailed description when taken in conjunction with the accompanying figures showing illustrative embodiments of the present disclosure.

Figure 1:
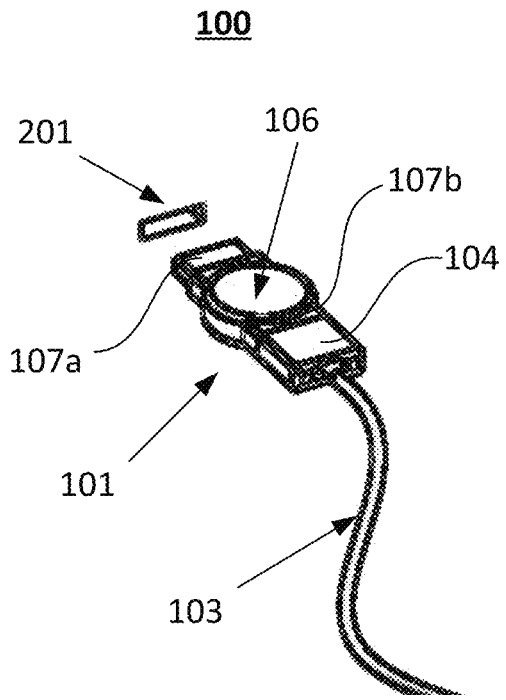
FIG. 1 shows a self-aligning and self-assembling, magnetically coupled connector 100 being connected into a connector port 201.

Throughout the figures, the same reference numerals and characters, unless otherwise stated, are used to denote like features, elements, components or portions of the illustrated embodiments. Moreover, while the subject disclosure will now be described in detail with reference to the figures, it is done so in connection with the illustrative exemplary embodiments. It is intended that changes and modifications can be made to the described exemplary embodiments without departing from the true scope and spirit of the subject disclosure as defined by the appended claims.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached", "coupled" or the like to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown in one embodiment can apply to other embodiments. It will also be appreciated by those of skill in the art that references to a structure or feature that is disposed "adjacent" to another feature may have portions that overlap or underlie the adjacent feature.

DETAILED DESCRIPTION OF EXEMPLARY EMBODIMENTS

The embodiments are based on an object of providing a self-aligning and self-assembling electronic connector to transfer data and/or electrical power between two electronic devices or between an electronic device and an electrical outlet. According to the various embodiments, it is provided a connector for electronic devices, wherein the connector includes at least two coupling portions which can be reconnected and reassembled preferably without manual intervention of a user.

Embodiment 1

A first exemplary embodiment is described by referring to FIGS. 1 through 6.

FIG. 1 shows an exemplary connector apparatus 100 in a disconnected state. The connector apparatus 100 (also referred to as connector 100) includes a cord 103 and a connector body lot configured to be connected into a connector port 201. The connector body lot includes two or more coupling portions which can engage or disengage from each other when a threshold force is applied to at least one of these coupling portions. In the first embodiment, the connector body lot includes a first coupling portion 106 and a second coupling portion 104. The first coupling portion 106 includes a connecting part 107*a* (or electronic mating piece) configured to electronically connect to the connector port 201, and an engaging part 107*b* configured to engage with the second coupling portion 104. In turn, the second coupling portion 104 is attached to the cord 103. If the connector 100 is a USB connector, the connecting part (or mating piece) 107*a* is a USB plug (the mating portion of a USB cable or a USB memory device), and the connection port 201 is a USB receptacle or port.

The connector port 201 is a connector port of an electronic device or a port of an electrical outlet. For example, the connector port 201 is a universal serial bus (USB) port or similar for data transfer. Alternatively the connector port 201 could also be a port to transfer electrical power between a wall socket and a piece of equipment or electronic device, e.g., for battery recharging. The connector port 201 can be a combination of a port for data transfer and a port for electrical power transfer. Accordingly, the connector 100 is a USB connector configured to electronically connect to connector port 201. The connector apparatus (100) configured to connect to a connection port (201) in order to transfer data and/or electrical power between two electronic devices or between an electronic device and an electrical outlet.

Figure 2:
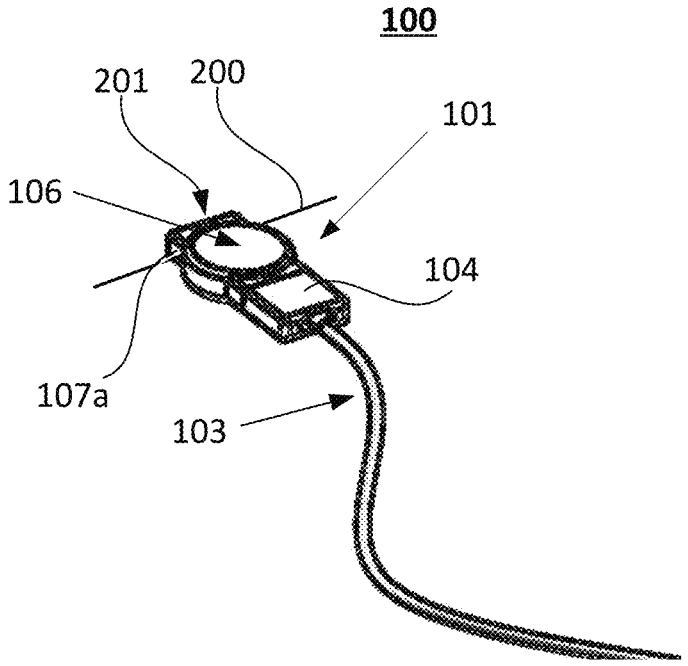
FIG. 2 shows the connector 100 seated in the connector port 201 of an electronic device 200.

FIG. 2 shows the connector apparatus 100 in a connected state. Specifically, in FIG. 2, the connector body lot is seated in the port 201 of an electronic device (or power socket) 200. The connection between connector port 201 and the connector 100 is a manual connection made by friction, as it is known in the art. The second coupling portion 104 is held attached to the first coupling portion 106 by an attracting force provided by, for example, two or more magnets. In the connected state, as shown in FIG. 2, the connector 100 is enabled to transfer electrical power or electronic data, or both electricity and electronic data, from a first electronic device 200 to a non-illustrated second electronic device via the cable or cord 103. The electrical connections of the connector apparatus 100 are preferably designed such that the connection is viable regardless of the orientation and/or separation of the two coupling portions (106 and 104) relative to each other.

Figure 3A:
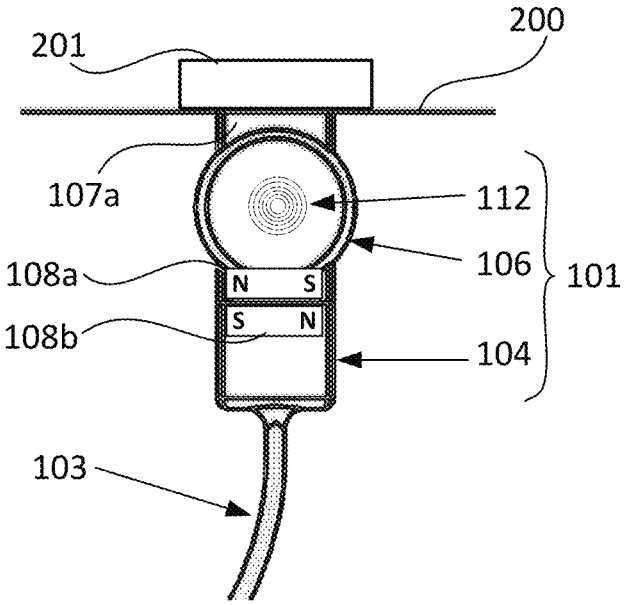
FIG. 3A shows the connector 100 including two coupling portions.
Figure 3B:
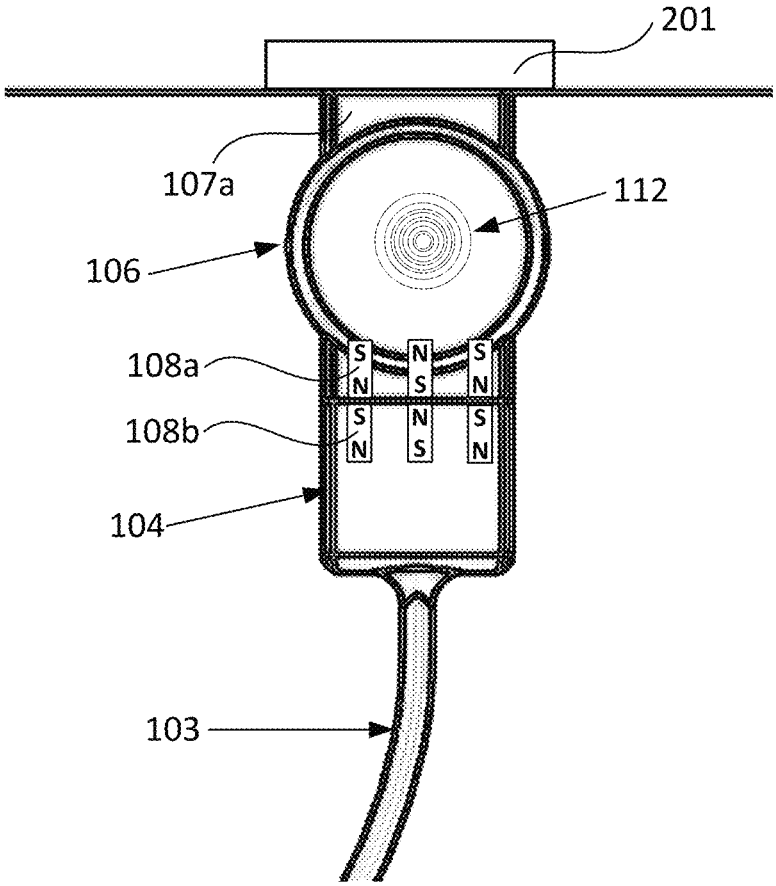
FIG. 3B shows the connector 100 including a first coupling portion 106 and a second coupling portion 104 aligned to each other with a plurality of pre-oriented magnets.

FIG. 3A shows a top view of the assembly of connector apparatus too to an electronic device 200. As shown in FIG. 3A, the connector apparatus too enables the connection of the first coupling portion 106 to an electronic device 200 via the connecting part 107*a* (a mating piece), and the connection of the second coupling portion 104 to a non-illustrated (second) electronic device via the cord 103. In this situation, the cord 103 may be placed in a position to be stepped-on, kicked, snagged, or tugged. However, according to the present disclosure, even if the cord 103 is placed in such a situation to be snagged and tugged, the connector 100 can ensure not only that the electrical connection is maintained, but also that the cord 103 returns to its original assembled position. To that end, the main body lot includes a retracting mechanism, such as a spring reel 112, and a tether 105 attaching the first coupling portion 106 to the second coupling portion 104. In the connected state illustrated in FIGS. 1-3, the spring reel 112 and tether 105 are disposed inside the main body lot, e.g., inside the first coupling portion 106 and/or inside the second coupling portion 104. In addition, the connector 100 can be provided with a pair of magnets 108*a* and 108*b*, which are aligned with each other to attract the first coupling portion 106 and second coupling portion 104 towards each other. In the event that the cord 103 is accidentally tugged, the magnets 108*a* and 108*b* maintain the first coupling portion 106 coupled to the second coupling portion 104 by the attracting magnetic force the two magnets. If the tugging force is larger than the attracting magnetic force of the two magnets, the first coupling portion 106 and the second coupling portion 104 become detached from each other; this causes the tether 105 to deploy and extend until the separating force (tugging force) stops acting on the coupling portion(s). To increase the magnetic force that maintains the first coupling portion 106 coupled to the second coupling portion 104, the number of magnets 108*a* and 108*b* can be increased as shown in FIG. 3B. For example, FIG. 3B shows the connector includes 3 pairs of magnets aligned to each other to maintain the two coupling portions tightly coupled to each other. Nevertheless, it is contemplated that there can be a greater tugging force applied to cord 103, which force will cause the second coupling portion 104 to become separated from the first coupling portion 106.

Figure 4A:
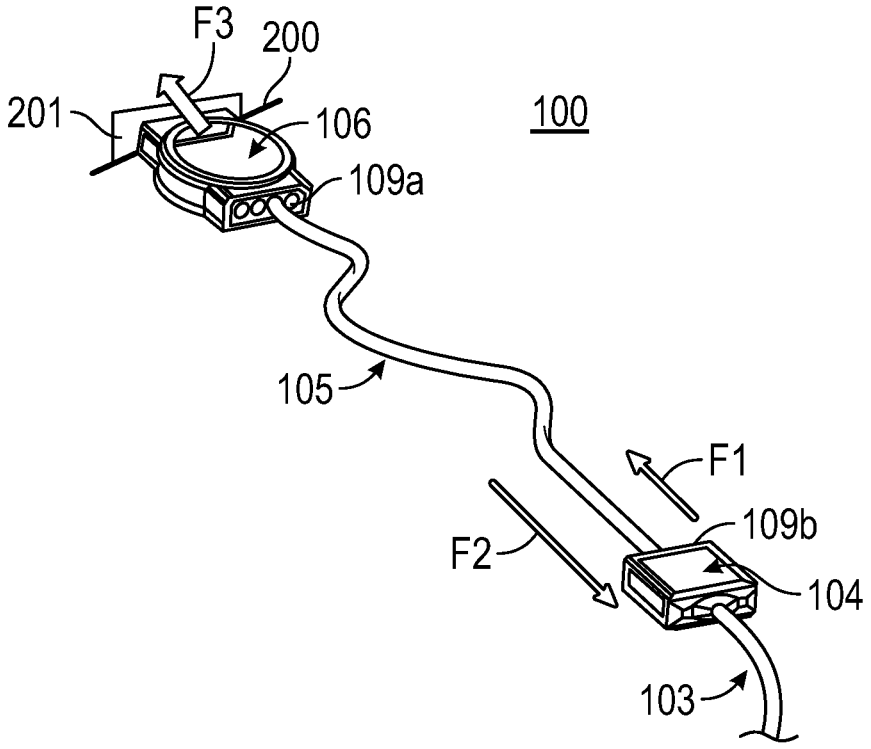
FIG. 4A illustrates the decoupling and coupling behavior of coupling portions of the connector 100 when a force on the cord exceeds a threshold force.

FIG. 4A shows the connector apparatus too in a state where the first coupling portion 106 and the second coupling portion 104 are decoupled from each other. FIG. 4A illustrates the behavior of the connector 100 when a decoupling force F2 (e.g., a tugging force) acting on the cord 103 exceeds a connecting or coupling force F1 (threshold force). The connecting or coupling force F1 refers, for example, to a friction force, magnetic force, or tension force necessary to maintain the first coupling portion 106 and the second coupling portion 104 coupled to each other. In some embodiments, the coupling force F1 may refer, for example, to a friction force necessary to connect a plurality of protruding connector pins 109*a* in the first coupling portion 106 to a corresponding plurality of holes or recessed connector terminals 109*b* (not shown) in the second coupling portion 104. In FIG. 4A, the pins 109*a* are components for establishing electrical connections with recessed connector terminals 109*b*. The electrical connections are not limited to pin/hole pairs; there may be other means of electrically connecting the first coupling portion 106 to second coupling portion 104 such that electrical power or digital signals (data) can be transmitted therebetween.

In an embodiment, the first and second coupling portions (106, 104) may be engaged or coupled to each other by the friction force between the pins 109 engaging recessed connector terminals 109*b* (holes). Then, if the decoupling force F2 is larger than the coupling force F1, the second coupling portion 104 becomes separated from the first coupling portion 106. Therefore, in this scenario, the decoupling force F2 causes the protruding connector pins 109*a* in the first coupling portion 106 to disconnect from the corresponding recessed connector terminals 109*b* in the second coupling portion 104. Accordingly, the disconnection of pins 109*a* from connector terminals 109*b* would cause a momentary electrical disconnection (stops the flow of electrical power or data) between the two coupling portions 106 and 104. However, according to the present embodiment, the two coupling portions 106 and 104 still remain physically attached to each other by a tether 105 which can retract and re-establish electrical connection. Therefore, even if an electrical connection is momentarily lost (interrupted) by an accidental pull of the cord 103, the spring reel 112 will pull back the tether 105 and cause the second coupling portion 104 to reconnect to the first coupling portion 106.

More specifically, the first coupling portion 106 has the internal retracting mechanism, such as a spring reel 112, to apply a tension force upon the tether 105. In this manner, when the force F2 acting on the cord 103 is released (when the force F2 ceases to act), the tether 105 retracts, bringing the first coupling portion 106 and second coupling portion 104 into close proximity so that the pin/hole pairs are reconnected to each other. To facilitate self-alignment and ensure fast re-assembling of the connector 100, the two coupling portions may include the magnets 108*a* and 108*b* of opposite polarity, as shown in FIG. 3A or FIG. 3B, so that the magnets are magnetically attracted. Preferably, the magnets and the first and second coupling portions are designed such that the two coupling portions self-align and re-assemble when force F2 stops acting upon the second coupling portion 104. Then, since the first coupling portion 106 has the internal retracting mechanism pulling on the tether 105, the two coupling portions 106 and 104 return to, and remain in, assembled configuration as shown in FIG. 2 and FIG. 3A-3B.

Figure 4B:
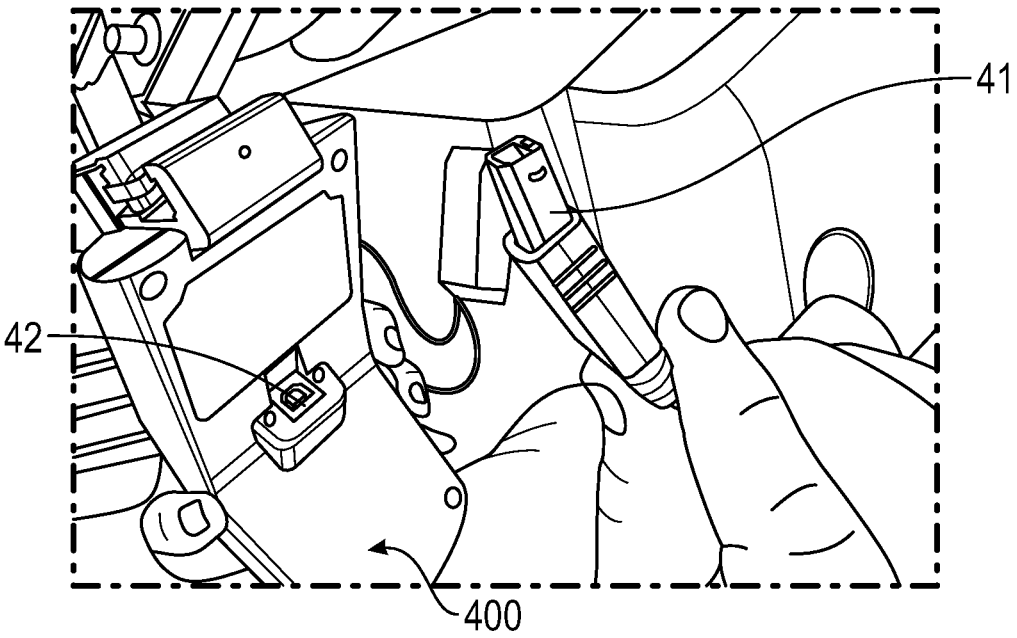
FIG. 4B shows an example of connector and port damage when a connector is provided without at least one self-aligning and self-assembling coupling portion.

FIG. 4B is a picture exemplary illustrating a situation which the inventors herein have encountered in conventional connections of electronic medical equipment 400 in a sterile clinical setting. For example, a computer cable 41 was subjected to a force of tugging, and the connector 40 with its associated port 42 were both damaged.

To avoid damage of the connector and/or its associated port, the present disclosure provides a mechanism which causes the first coupling portion 106 and the second coupling portion 104 to disengage from each other at a certain force (F2) larger than a threshold force F1, but lower than an engaging force F3 which keeps the connector 100 attached to connection port 201. The force F2 is lower than the engaging force F3 (e.g., friction force) keeping the part 107*a* of connector 100 engaged with connector port 201. The disengagement force (F2) is also less than a damaging force Fd, if such force Fd is applied to the connector 100, which would damage the part 107*a* or the port 201.

Further, the disengagement force (F2) is high enough such that first coupling portion 106 and the second coupling portion 104 stay engaged until a certain threshold force is reached. Specifically, the disengagement force F2 is high enough such that the connector remains engaged and unaffected by the weight of the cord 103 and/or even if minor incidental forces are applied to the connector during normal operations of maneuvering electronic equipment.

Conventional basic connectors (e.g., USB connectors) use friction force in a push/pull interface for connecting/disconnecting a cable connector to a receptacle or port. These connectors are prone to easy disconnection as outlined above. Since the inadvertent separation of a cable is a serious concern due to loss of data or loss of power when the mated interface is accidentally broken, a proposed solution is to provide a locking mechanism (e.g., a latch) within the receptacle or port (see, e.g., U.S. Pat. No. 7,128,595) or within the connector (see, e.g., U.S. Pat. No. 6,902,432 or 7,878,865) for releasably locking the connector to its connection port (or receptacle). Although this type of locking mechanism provides improved mating retention between the connector and its port, it increases the possibility of damage when an accidental tug or pull occurs, and it also requires a user to actively maneuver the locking mechanism for connection and/or disconnection. In contrast, according to the present disclosure, the connector has one or more coupling portions (106, 104) which can engage or disengage when a separating force is applied to at least one of the coupling portions; this can prevent any damage to the connector and/or its receptacle even if the connection is secured with a locking mechanism. More specifically, since the retracting mechanism (105) pulls the two or more coupling portions (106, 104) towards each other when the coupling portions are separated by a separating force (F2) larger than a threshold force (F1), the connector disclosed herein can advantageously prevent damage of the connector and/or its port even when a locking or detent mechanism is provided between the connector and its port. In this case, the force necessary to overcome the locking mechanism (e.g., necessary to disengage the connector from its port) can be considered the disengaging force F3. In conventionally locked connectors, when the force F3 is much larger than separating force F2 (if F3>>F2), the connector or its port could be permanently damaged. However, when the connector is provided with at least one coupling portion that can engage and disengage in response to a separating force (tugging force), both damage and disconnection can be prevented. To that end, the first part (107*a*) of connector 100 can remain connected to the connection port (201), even while the two or more coupling portions (106, 104) disengage from each other when the force F2 is applied and/or while the retracting mechanism (105) pulls the two or more coupling portions (106, 104) towards each other with a force F1.

Figure 5A:
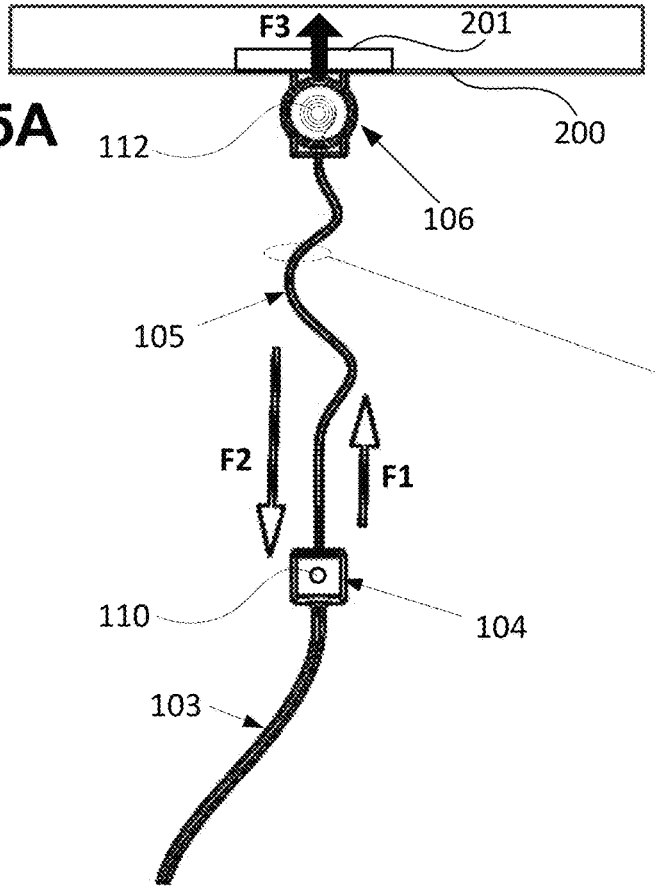
FIG. 5A shows the disconnection and re-connection process of first and second coupling portions of connector 100.
Figure 5B:
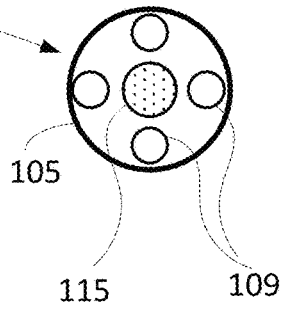
FIG. 5B shows an exemplary cross-sectional view of a tether 105 according to one embodiment.

FIG. 5A shows a variation of connector 100 where the force F1 corresponds to the friction/tension force of the reel spring 112, the force F2 corresponds to a tugging force sufficient for decoupling the first and second coupling portions 106 and 104 from each other, and the force F3 is the engaging force (friction, magnetic and/or locking force) making the electrical connection of the connector 100 to the connector port 201. In an embodiment, as shown in FIG. 5A, the connector 100 may not include electronic connector pins 119*a* and corresponding recessed electronic connector terminals 109*b*. Instead, as shown in FIG. 5B, the electrical connection is maintained by providing a plurality of flexible electronic conductors 109 (flexible cables) which can retract together with retracing string or cord 115 inside the tether 105. In this manner, as shown in FIG. 5A and FIG. 5B, the novel connector 100 allows for the first coupling portion 106 and the second coupling portion 104 to be disengaged and re-assembled, while the connector 100 still maintains constant electrical or data connection between a first electronic device 200 and a second electronic device (not shown) via the cord 103. The electrical connection between the first electronic device 200 and the connector 100, or the coupling state of the first and second coupling portions 106 and 104 can be monitored by providing a status indicator 110.

Figure 6A:
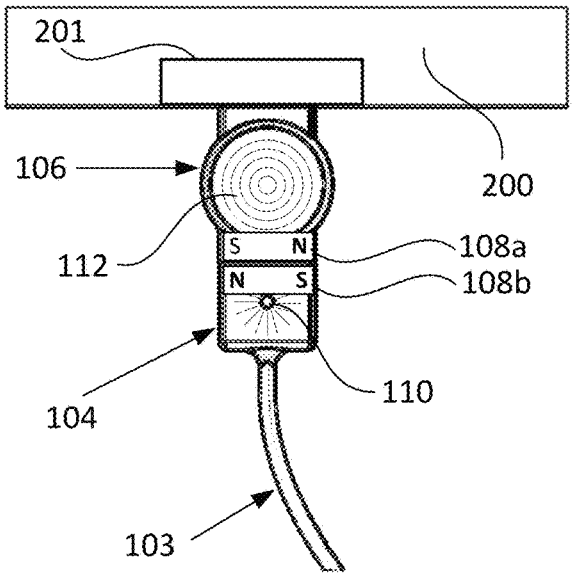
FIG. 6A illustrates connector 100 with a connection status indicator provided in one part of the connector.
Figure 6B:
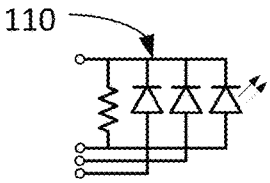
FIG. 6B illustrates an exemplary circuit implementing the connection status indicator as a visual indicator.

FIG. 6A illustrates the connector 100 including a connection status indicator 110 which provides an indication to a user as to the connection status of the connector 100. FIG. 6B illustrates an exemplary circuit implementing the connection status indicator 110. The embodiment shown in FIG. 6*a* is substantially similar to the embodiment shown in FIGS. 1-3B, except for the status indicator. In its simplest form, the status indicator 110 can be configured to inform the user that a successful or viable electronic connection has been established between the first electronic device 200 and a second electronic device (not shown) via the connector 100. As shown in FIG. 6A, the status indicator 110 can be configured to emit a visual indication. An example of connection status indicator 110 is a light emitting diode (LED) provided on any part of the connector 100. For example, the LED could be provided on either one (or both) of the two coupling portions 106 and 104. A "viable" or operational connection of the connector 100 means a connection effective to transmit electric power and/or digital data between to electronic devices using the connector 100. During operation, the connection status indicator 110 indicates that a connection is active or viable by turning the LED light ON. The connection status indicator 110 is not limited to a light or visual indicator. The status indicator 100 can be replaced and/or combined with other types of status indicators such as acoustic or even haptic indicators. In one embodiment, the status indicator 110 can be configured to have a plurality of status indications (a plurality of statuses). For example, a status indicator 110 having a first status may include a green light which can indicate a viable or active electrical connection between two electronic devices, as explained above. A second status indicator can include an orange color light which can indicate the second coupling portion 104 has disengage (decoupled) from the first coupling portion 106. In this case, the orange color indicator can be a warning to the user indicating that a viable connection still exists, but the two coupling portions 106 and 104 are separated from each other (e.g., due to tugging of the cable). This "waring" status indicator can be particularly useful when the connector port 201 is located in a location difficult to access, and the status indicator 110 is provided in a location of the connector 100 where the user can easily assess the connection status. In this manner, for example, once the user is warned that the two coupling portions are disengaged, certain precautions can be taken to avoid a full disconnection of the connector 100 from its port 201. A third status indicator can inform the user that a viable connection has been lost or has not been established at all. The third status indicator can be a red light indicator or no light at all.

Embodiment 2

Figure 7:
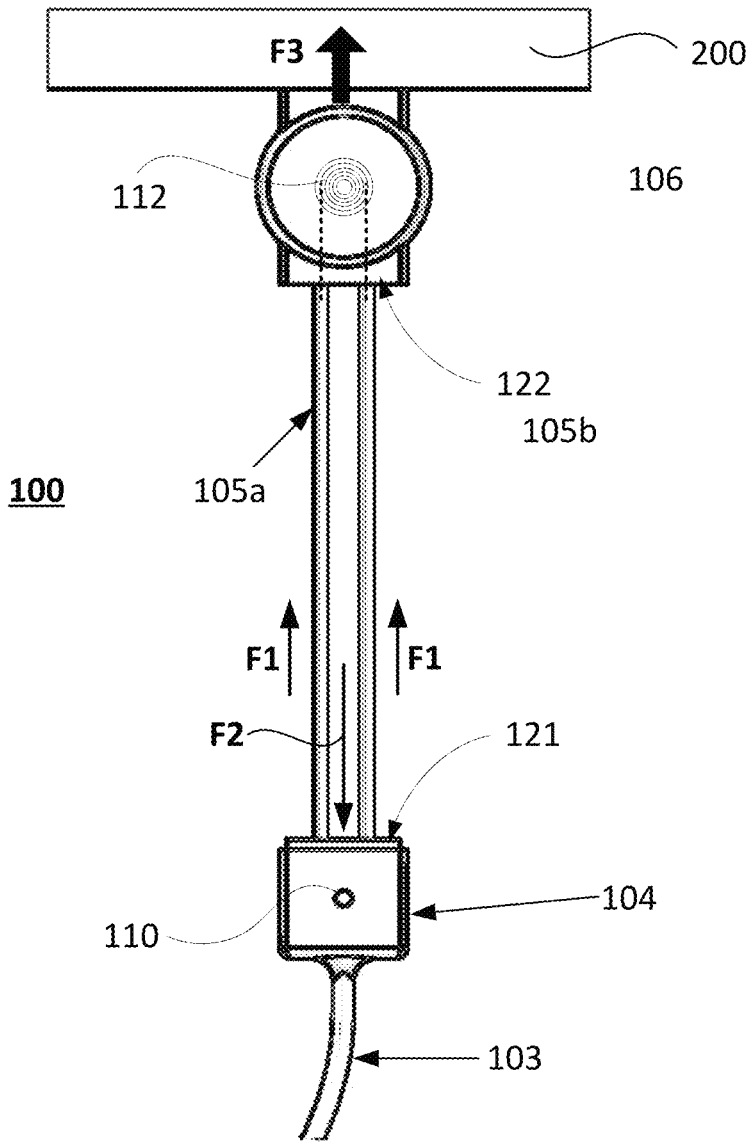
FIG. 7 depicts an alternate embodiment of a connector 100 including a plurality of tethers.

FIG. 7 depicts an alternate embodiment of the connector 100. As shown in FIG. 7, the connector apparatus too still includes a main body lot comprised of a first coupling portion 106 and a second coupling portion 104. In this embodiment 2, the first coupling portion 106 and the second coupling portion 104 are attached to each other by a plurality of tethers 105*a*, 105*b*. This embodiment offers not only the advantage of a greater coupling force between the two coupling portions, but also provides improved orientation for reassembling. Specifically, the plurality of tethers 105*a* and 105*b* preserves the top side and bottom side orientation between the first coupling portion 106 and the second coupling portion 104. In this manner, since the plurality of tethers aids in the alignment of the coupling portions and provides a greater coupling force, the two coupling portions 106 and 104 need not be magnetized to self-align and self-assemble.

In the second embodiment, similar to the first embodiment, the first coupling portion 106 has an internal retracting mechanism, such as a spring reel 112 for each tether, to apply tension upon the tethers 105*a*, 105*b*. In this manner, when a force on the cord 103 is released (when the force F2 ceases to act), the tethers 105*a* and 105*b* retract, bringing the first coupling portion 106 and second coupling portion 104 back to their coupled position, e.g., as shown in FIG. 6. In the embodiment of FIG. 7, the digital signal and/or electrical power is transmitted between the first coupling portion 106 and second coupling portion 104 via a protruding electrical mating piece 121 such as a 30-pin male connector configured to connect to a corresponding 30-pin female connector 122.

Embodiment 3

Another embodiment of connector 100 is to forgo the magnets in embodiment 1, and have the first coupling portion 106 and second coupling portion 104 brought together and held together only by the retraction force of the tether 105. In this case, magnetic coupling may be obviated, but it is recommended to provide some type of complementary guiding elements to facilitate realignment and self-assembling of the coupling portions. This is discussed below with respect to FIG. 8, for example.

Embodiment 4

Another variation of embodiment 1 is to align the poles of the magnets in the connector 100 such that the magnetic force of the magnetic pieces (magnets) in the first coupling portion 106 is predisposed to a preferred alignment with the magnetic pieces (magnets) in the second coupling portion 104. See, for example, FIG. 3B. In this manner, the first and second coupling portions will be self-aligned by the orientation of the magnetic pieces, and self-assembled by the tension of the spring reel 112 acting on the self-retracting tether 105.

Embodiment 5

Figure 8:
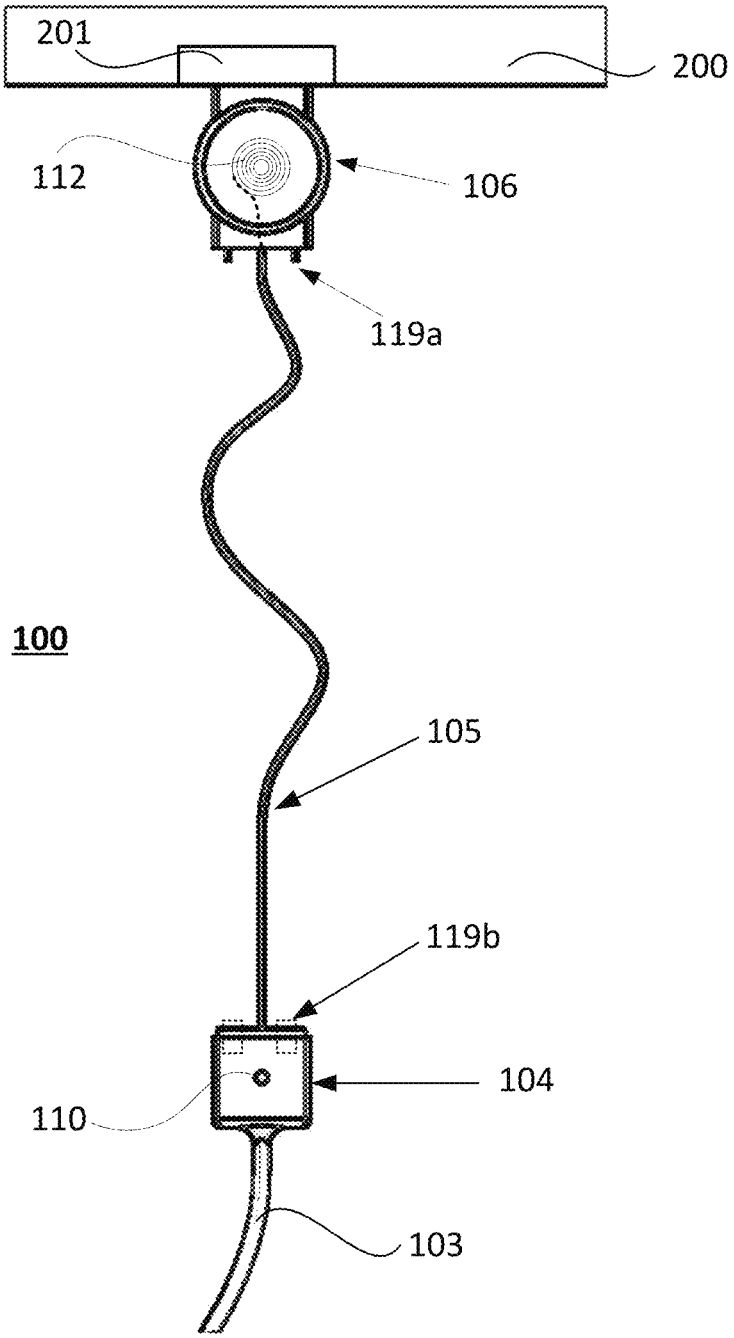
FIG. 8 depicts a connector 100 including a plurality of alignment pins 119*a* and recesses 119*b* to aid in positioning and self-aligning the first and second coupling portions of the connector.

FIG. 8 illustrates a connector 100 according to another embodiment. As shown in FIG. 8, the main body lot of connector 100 still includes a first coupling portion 106 and a second coupling portion 104. Similar to the previous embodiments, the two or more coupling portions are attached to each other by one or more tethers 105. In addition, according to this embodiment, the first coupling portion 106 includes alignment pins 119*a* which are configured to align with holes 119*b* provided in the second coupling portion 104. That is, in FIG. 8, the pins 119*a* are not electrical connection pins, but merely alignment pins configured to align with holes 119*b*. In this manner, according to this embodiment, the alignment pins 119*a* and receiving holes 119*b* serve to aid in positioning and aligning the first coupling portion 106 to the second coupling portion 104. In this manner, the first and second coupling portions 106 and 104 will be self-aligned by the orientation of the pins 119*a* and holes 119*b*, and self-assembled by the tension of spring reel 112 pulling on the self-retracting tether 105. Here, similar to FIG. 5A or 5B, rather than having the connection via pins/hole pairs or other electrical contacts, the electrical power and/or digital signal is transmitted through the retracting tether 105 which includes thereinside a retraction cord 115 and conducting cables 109 (see FIG. 5B).

Embodiment 6

Figure 9:
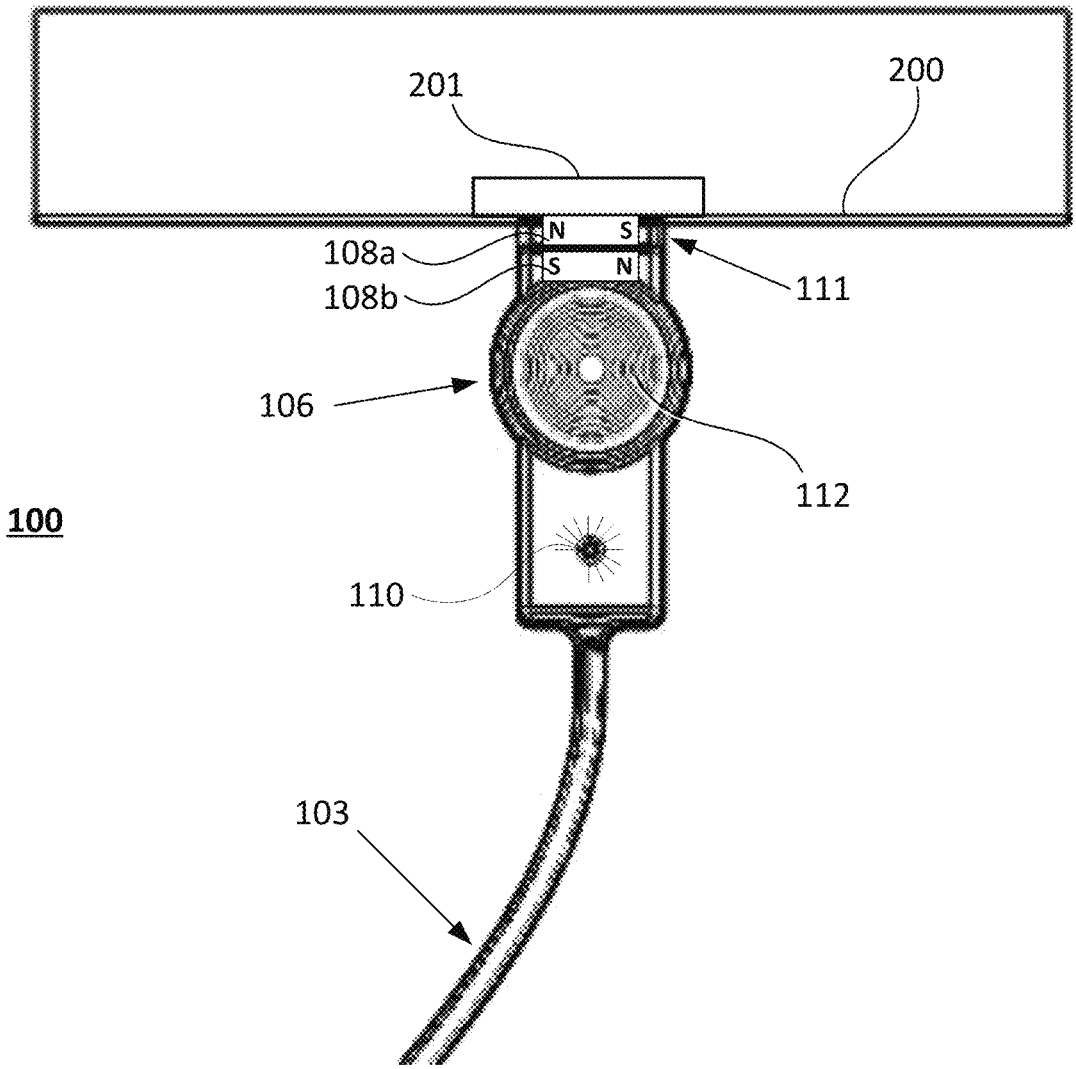
FIG. 9 shows connector 100 with an alternate split point between a mating piece 111 and a first coupling portion 106.

FIG. 9 shows an alternate embodiment of a connector 100. In FIG. 9, the main body lot of connector 100 includes an alternate split point between the mating piece and the coupling portion. In this configuration, the main body lot of connector 100 includes a mating piece 111, and only one coupling portion (the first coupling portion 106). Similar to the previous embodiments, the mating piece 111 includes the connecting terminals configured to make a viable connection with a connector port 201 of an electronic device 200 or an electrical outlet. In this embodiment, the first coupling portion 106 is attached to the mating piece 111 by one or more tether(s) 105 (not shown). The mating piece 111 interfaces with the connection port 201 of the first electronic device 200. Unlike the previous embodiments, a spring reel 112, which tensions the tether 105, resides within the first coupling portion 104, and the connection status indicator 110 is also provided in the first coupling portion 106. The present embodiment differs from other embodiments in that the spring reel 112 resides with the part being detached from the mating piece 111. That is, mating piece 111 stays connected with the connection port 201 due to the friction connection therebetween. The coupling portion 106 houses the spring reel 112 and connection status indicator 110. Coupling portion 106, at a given force F2, detaches from mating piece 111, and the tether 105 extends as shown in the previous embodiments. When the detaching force F2 stops acting on the cord 103, spring reel 112 causes the tether 105 to pull the coupling portion 106 back towards the mating piece 111. For alignment, the embodiment shown in FIG. 9 may use magnets (108*a* and 108*b*) of opposite polarity and/or protruding guides (pins) on the mating piece 111 facing recessed guides (hole) in the first coupling portion 106. One advantage of this embodiment as compared to the other embodiments is that number of coupling portions is reduced which can reduce the cost of the connector.

Embodiment 7

Figure 10:
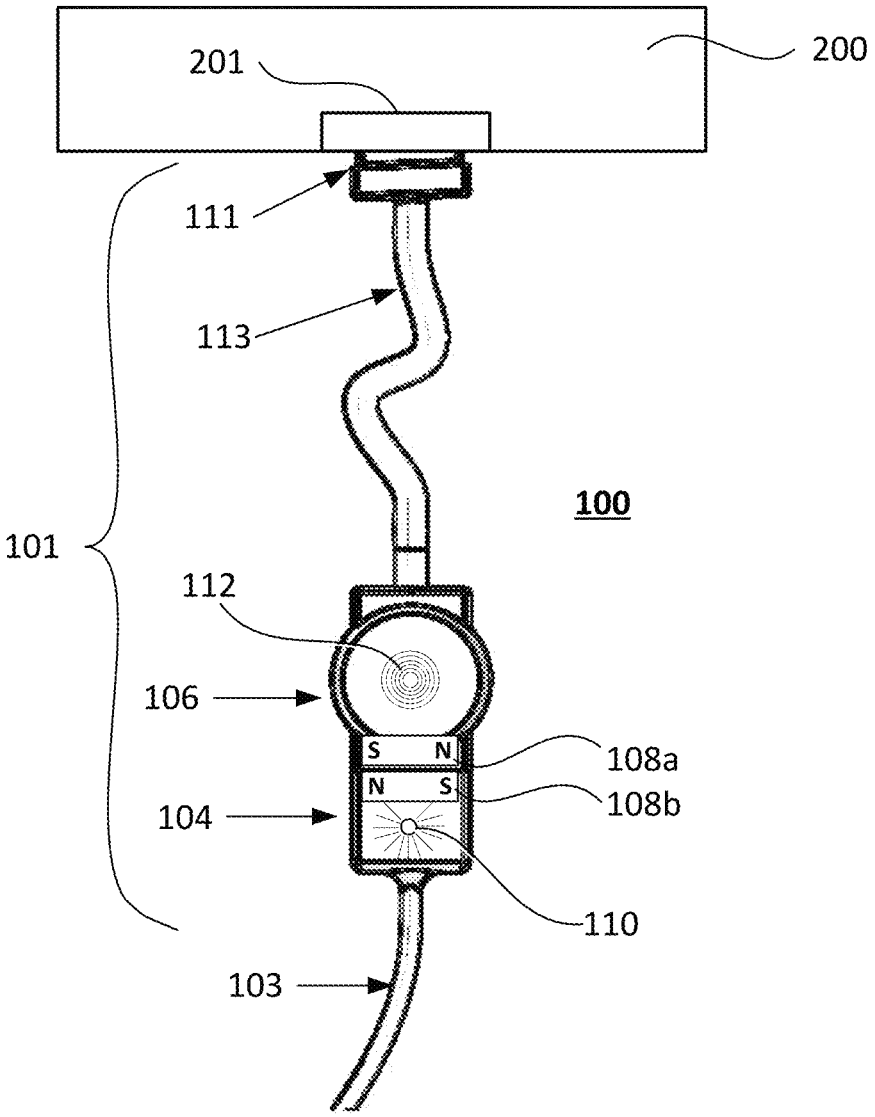
FIG. 10 to shows a connector 100 similar to the connector of FIG. 1 with an additional dongle cable 113 between the mating parts. The purpose/advantage of cable 113 is to provide further isolation of connector port 201 from damaging forces exerted on the connector assembly.

FIG. 10 to illustrates further embodiment of a connector 100. The connector according to FIG. 10 to includes a decoupling assembly of at least two portions with a split between a first coupling portion 106 and a second coupling portion 104 just like in the embodiment of FIG. 1. In addition, according to FIG. 10, the connector 100 includes a dongle or cable 113 to provide further isolation of connector port 201 from damaging forces exerted on the assembly. The main body 101 of connector 100 includes a port interface or mating piece 111, a dongle or cable 113, a first coupling portion 106, and a second coupling portion 104. Similar to the previous embodiments, the first coupling portion 106 and second coupling portion 104 are attached to each other by one or more tether(s) 105 (not shown). The port interface or mating piece 111 plugs into the connection port 201 of a first electronic device 200. The cable 113 connects the port interface or mating piece 111 to the first coupling portion 106 which houses the spring reel 112. The first coupling portion 106 is tethered and/or magnetically coupled with the second coupling portion 104. In this case too, the first coupling portion 106 includes at least one magnet 108*a*, and the second coupling portion 104 includes at least one magnet 108*b* to aid on the alignment and self-assembly of the two coupling portions. The working principle of the connector 100 shown in FIG. 10 to is similar to that of the previous embodiments shown in FIGS. 1-3A and/or FIGS. 6A-6B, where a connection status indicator 110 is provided in at least one the coupling portions to inform the user of a status of connection.

The concept described in present disclosure is related primarily to a connector having two or more coupling portions configured to engage or disengage in response to a force applied to at least one of said portions. Advantageously, the coupling portions are self-aligning and self-assembling particularly after the coupling between the two portions is disconnected. This offers a significant advantage over conventional connectors, particularly in a clinical setting, where multiple cords and the associated ports may be inaccessible for manual reconnection. In a sterile clinical setting, even when a reconnection is possible, a sterile user would have to break sterility to be able to manually realign and reassemble a disconnected connector.

The various embodiments described in the present disclosure address the issues of lack of accessibility for reconnection in that, as soon as the disconnection force (e.g., a tugging force) is removed, the connector self-aligns and re-assembles without interaction from the user.

Certain notable aspects of the various embodiments include, without limitation, a connector attached to a cord which transmits electrical power and/or a digital signal (data) between two electronic devices or between an electronic device and an electrical outlet. The connector has two or more coupling portions which can disengage from each other when a threshold force is applied to at least one of the two coupling portions. The disengagement force is preferably lower than a force which might damage portions of the cord or connector which cannot disengage. The two coupling portions are tethered to each other with a retraction mechanism which pulls the coupling portions towards each other. The retraction mechanism may include a spring and a cord which maintains the two coupling portions engaged to each other in a normal (resting) state. Then, when coupling portions are separated, the retraction mechanism pulls the coupling portions towards each other. There can be one or a plurality of tethers used to join the coupling portions. In some embodiments, the coupling portions include magnets which are specifically aligned to pull the coupling portions towards each other when they are separated.

The two magnetically coupled portions are designed such that when they are close proximity to each other, they attract each other and self-align into a viable connection. Such designs include lead-in features to help self-alignment. One or more portions of the connector includes a connection status indicator which is light emitting element to indicate the connection status of the connection. The mating surfaces of the coupling portions may have protrusions (pins) and mating holes to aid the alignment of coupling portions. An alternate connection method forgoes the magnetic coupling and has the mating pieces assembled and held in connection purely by the force of the retracting tether or tethers. When using magnetically coupling portions, the poles of the connection magnets are aligned such that the magnetic force of the coupling portions are predisposed to a preferred alignment.

The retracting tether feature of the connector described in the present disclosure allows the two coupling portions to disengage from each other when a separating force is applied to the cord, and enables self-re-assembly upon separation of the coupling portions while maintaining a viable connection of the connector to a connection port. This is a notable feature which is absent in known electrical connectors.

While FIGS. 1-6 have illustrated different configurations and features that may be incorporated into data or electrical power connectors, it will be understood by those skilled in the art that these configurations are not limited to a specific type of connectors. Any type of connector can be applied to the embodiment of FIGS. 1-6 and the modifications shown in FIGS. 7-10. For example, any of the connectors described herein can be implemented in USB communication including USB 1.0, USB 2.0, as well as USB 3.0 (which includes SuperSpeed bus) communication standard, and other variants of USB. Still other types of standard communication could also be implemented via a connector 100, such as, but not limited to, RS-232, RS-485, Firewire (IEEE 1394), HDMI (high definition multimedia interface), Ethernet®, and still others which will become evident to those skilled in the art.

Definitions

In referring to the description, specific details are set forth in order to provide a thorough understanding of the examples disclosed. In other instances, well-known methods, procedures, components and circuits have not been described in detail as not to unnecessarily lengthen the present disclosure. Unless defined otherwise herein, all technical and scientific terms used herein have the same meaning as commonly understood by one of ordinary skill in the art to which this invention belongs. The breadth of the present invention is not to be limited by the subject specification, but rather only by the plain meaning of the claim terms employed herein. As used herein; a "digital signal" refers to a signal that is being used to represent data as a sequence of discrete values; "electrical power" refers to the rate, per unit time, e.g., watts or one joule per second, at which electrical energy is transferred by an electric circuit.

It should be understood that if an element or part is referred herein as being "on", "against", "connected to", or "coupled to" another element or part, then it can be directly on, against, connected or coupled to the other element or part, or intervening elements or parts may be present. In contrast, if an element is referred to as being "directly on", "directly connected to", or "directly coupled to" another element or part, then there are no intervening elements or parts present. When used, term "and/or", may be abbreviated as "/", and it includes any and all combinations of one or more of the associated listed items, if so provided.

Spatially relative terms, such as "under" "beneath", "below", "lower", "above", "upper", "proximal", "distal", and the like, may be used herein for ease of description to describe one element or feature's relationship to another element(s) or feature(s) as illustrated in the various figures. It should be understood, however, that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a relative spatial term such as "below" can encompass both an orientation of above and below. The device may be otherwise oriented (rotated 90 degrees or at other orientations) and the spatially relative descriptors used herein are to be interpreted accordingly. Similarly, the relative spatial terms "proximal" and "distal" may also be interchangeable, where applicable.

The term "about" or "approximately" as used herein means, for example, within 10%, within 5%, or less. In some embodiments, the term "about" may mean within measurement error. In this regard, where described or claimed, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range, if recited herein, is intended to include all sub-ranges subsumed therein.

The terms first, second, third, etc. may be used herein to describe various elements, components, regions, parts and/or sections. It should be understood that these elements, components, regions, parts and/or sections should not be limited by these terms. These terms have been used only to distinguish one element, component, region, part, or section from another region, part, or section. Thus, a first element, component, region, part, or section discussed below could be termed a second element, component, region, part, or section without departing from the teachings herein.

The terminology used herein is for the purpose of describing particular embodiments only and is not intended to be limiting. As used herein, the singular forms "a", "an", "said" and "the", are intended to include the plural forms as well, unless the context clearly indicates otherwise. It should be further understood that the terms "includes" and/or "including", when used in the present specification, specify the presence of stated features, integers, steps, operations, elements, and/or components, but do not preclude the presence or addition of one or more other features, integers, steps, operations, elements, components, and/or groups thereof not explicitly stated. It is further noted that some claims may be drafted to exclude any optional element; such claims may use exclusive terminology as "solely," "only" and the like in connection with the recitation of claim elements, or it may use of a "negative" limitation.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

While the present disclosure has been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

The invention claimed is:

1. A connector apparatus configured to connect to a connection port in order to transfer a digital signal and/or electrical power between two electronic devices or between an electronic device and an electrical outlet, the connector apparatus comprising:

a first part configured to connect to the connection port;

a plurality of coupling portions which can engage or disengage between each other when a force is applied to at least one of the coupling portions; and a retracting mechanism which pulls the plurality of coupling portions towards each other when at least one of the coupling portions is separated from the other by a separating force larger than a threshold force;

wherein the first part remains connected to the connection port, while the at least one of the coupling portions engages or disengages when the force is applied, and/or while the retracting mechanism pulls the plurality coupling portions towards each other.

2. The connector apparatus according to claim 1, wherein the plurality of coupling portions includes a first coupling portion having one or more first magnets and a second coupling portion having one or more second magnets, and wherein the first and second coupling portions are magnetically coupled to each other by interaction of the one or more first magnets with the one or more second magnets.

3. The connector apparatus according to claim 2, further comprising a cord attached to at least one of the first and second coupling portions, wherein the cord transmits the digital signal and/or electrical power between two electronic devices or between an electronic device and an electrical outlet regardless of whether the first and second coupling portions are engaged or disengaged.

4. The connector apparatus according to claim 1, wherein the threshold force is a force equal to a tension force exerted by the retracting mechanism to maintain the plurality of coupling portions engaged to each other; and wherein the separating force is higher than the threshold force and lower than a damage force which can damage portions of the connector which cannot disengage from the connection port.

5. The connector apparatus according to claim 1, wherein the threshold force is a force equal to a tension force exerted by the retracting mechanism to maintain the plurality of coupling portions engaged to each other; and wherein the separating force is higher than the threshold force and lower than an engaging force for engaging the first part to the connection port.

6. The connector apparatus according to claim 2, wherein the threshold force is a force equal to a magnetic force exerted by the interaction of the one or more first magnets with the one or more second magnets to maintain the first and second coupling portions magnetically coupled to each other; and wherein the separating force is higher than the threshold force and lower than an engaging force for engaging the first part to the connection port.

7. The connector apparatus according to claim 2, wherein the retracting mechanism is a self-retracting tether, and wherein the first and second magnetically coupled portions are tethered to each other with the self-retracting tether which pulls together the two magnetically coupled portions when they are separated by the separating force.

8. The connector apparatus according to claim 7, wherein the self-retracting tether includes one or a plurality of tethers.

9. The connector apparatus according to claim 2, wherein the first and second magnetically coupling portions have protruding portions and mating holes configured to align the two or more coupling portions to each other.

10. The connector apparatus according to claim 9, wherein the retracting mechanism includes a spring reel and a self-retracting tether, wherein the first and second magnetically coupled portions are tethered to each other with the self-retracting tether which pulls together the two magnetically coupled portions when they are separated by the separating force; and wherein the digital signal and/or electrical power is transmitted through electrical cables included in the self-retracting tether.

11. The connector apparatus according to claim 2, wherein the one or more first magnets and the one or more second magnets are arranged such that when the two magnetically coupling portions are in close proximity to each other, the one or more first magnets attract the one or more second magnets so that the two magnetically coupling portions engage each other and self-align into a viable connection.

12. The connector apparatus according to claim 1, further comprising a connection status indicator provided in at least one of the two or more coupling portions.

13. The connector apparatus according to claim 12, wherein the connection status indicator includes a light emitting unit configured to emit light to indicate one or more connection status of the connector apparatus.

14. The connector apparatus according to claim 7, further comprising a spring reel configured to apply a tension force upon the self-retracting tether.

15. An electrical connector, comprising:

a mating piece configured to be connected to a connection port of an electronic device or to an electrical outlet;

at least one coupling portion which can engage or disengage with the mating piece when a force is applied to the least one coupling portion; and a retracting mechanism which pulls the at least one coupling portion towards the mating piece when the at least one coupling portion is disengaged from the mating piece by a separating force larger than a threshold force;

wherein the threshold force is a force equal to a tension force exerted by the retracting mechanism to maintain the at least one coupling portion engaged to the mating piece; and wherein the mating piece remains connected to the connection port in electrical communication thereto, while the at least one coupling portion engages or disengages from the mating piece when the force is applied and/or while the retracting mechanism pulls the at least one coupling portion towards the mating piece.

16. The connector according to claim 15, wherein the mating piece is connected to the connection port with a locking mechanism included in either the connection port or the mating piece, and wherein the threshold force is a force equal to a tension force exerted by the retracting mechanism to maintain the at least one coupling portion engaged to the mating piece; and wherein the separating force is higher than the threshold force and lower than a engaging force for engaging the mating piece to the connection port using a locking mechanism.

17. The electrical connector according to claim 15, wherein the at least one coupling portion includes a first coupling portion having one or more first magnets, wherein the mating piece includes one or more second magnets, and wherein the at least one coupling portion is magnetically coupled to the mating piece by the one or more first magnets and the one or more second magnets.

18. The electrical connector according to claim 17, wherein the threshold force is a force equal to a magnetic force exerted by the one or more first magnets and the one or more second magnets to maintain the at least one coupling portion magnetically coupled to the mating piece; and wherein the separating force is higher than the threshold force and lower than an engaging force for engaging the mating piece to the connection port.

* * * * *